US007086832B2

(12) United States Patent
Lienau et al.

(10) Patent No.: US 7,086,832 B2
(45) Date of Patent: Aug. 8, 2006

(54) HIGH PRESSURE ROTARY PUMP IN A POT HOUSING WITH A PRESSURE CAP

(75) Inventors: Wolfram Lienau, Haeuslenen (CH); Paul Meuter, Seuzach (CH)

(73) Assignee: Sulzer Pumpen AG, Winterthur (CH)

( * ) Notice: Subject to any disclaimer, the term of this patent is extended or adjusted under 35 U.S.C. 154(b) by 96 days.

(21) Appl. No.: 10/703,367

(22) Filed: Nov. 7, 2003

(65) Prior Publication Data

US 2004/0096324 A1 May 20, 2004

(30) Foreign Application Priority Data

Nov. 12, 2002 (EP) ..... 02405971

(51) Int. Cl.
*F04D 29/40* (2006.01)

(52) U.S. Cl. ..... 415/214.1

(58) Field of Classification Search ..... 415/118, 415/206, 214.1

See application file for complete search history.

(56) References Cited

U.S. PATENT DOCUMENTS 2,219,098 A * 10/1940 Dorer ..... 415/108
2,281,631 A 5/1942 Spillmann et al.
3,118,386 A 1/1964 Carswell
3,135,538 A * 6/1964 George ..... 285/363
4,098,558 A * 7/1978 Bush et al. ..... 415/199.1
5,063,661 A * 11/1991 Lindsay ..... 29/888.02
5,230,540 A * 7/1993 Lewis et al. ..... 285/363
5,511,941 A * 4/1996 Brandon ..... 415/214.1

FOREIGN PATENT DOCUMENTS

EP 0248104 A1 12/1987

* cited by examiner

*Primary Examiner*—Ninh H. Nguyen
(74) *Attorney, Agent, or Firm*—Townsend and Townsend and Crew LLP

(57) ABSTRACT

The high pressure rotary pump in a pot housing includes a pressure cap (3). The latter has a flange part with a flange (4) with which the pressure cap is fastened to an end face and annular sealing surface (20) of a housing (2) by being screwed into place. The flange is elastically deformed by being screwed into place. The sealing surface of the housing in the region of a base zone of the flange stands in contact on this with a second sealing surface (40). The two sealing surfaces (20, 40) lie on two at least approximately radially extending conical or annular surfaces prior to the being screwed up. These two surfaces enclose an angle $\chi$ which opens outwardly with respect to a central axis (101). After the screwing into place of the flange, the two sealing surfaces are pressed onto one another due to its elastic deformations and thus the angle between the sealing surfaces is equal to zero.

16 Claims, 2 Drawing Sheets

HIGH PRESSURE ROTARY PUMP IN A POT HOUSING WITH A PRESSURE CAP

BACKGROUND OF THE INVENTION

The invention relates to a high pressure rotary pump in a pot housing with a pressure cap as well as to a use of this pump.

The pot housing pump is usually a multi-stage rotary pump in which the impellers are arranged in-line or back-to-back on the shaft. High pressures can be produced with this pump. As a rule, a drive unit is coupled to the shaft at the low pressure side. At the opposite side, the housing is terminated by the pressure cap. The pressure cap has a flange part with which sealing takes place against the internal pressure, i.e. against the pressure of a pumped liquid. A pot housing pump of the back-to-back type is known from EP-B-0 248 104, which includes two multi-stage rotary pumps arranged at a common shaft.

In a further development of this known pot housing pump, the pressure cap and the flange part provided for the sealing form a unit, with the flange simultaneously serving as a fastening means. It is fastened to the end face of the housing by means of a plurality of expansion bolts. An annular groove into which an O-ring is placed as a seal is let into a sealing surface of the housing. The pressure of the pumped fluid brings about a load on the pressure cap due to which the sealing flange area can raise so far that a leak occurs. An attempt has been made to remedy this defect in that the sealing surface is reduced to a narrow annular zone at the base of the flange and a contact between the flange and the sealing surface of the housing outside the annular zone is eliminated by cutting back the flange surface. The pressure intensity in the sealing region was thereby increased; however, without achieving the desired effect of a leak-free seal.

SUMMARY OF THE INVENTION

It is an object of the invention to provide a pump with a sealing pressure cap in which the seal remains free of leaks.

The high pressure rotary pump in a pot housing includes a pressure cap 3. This has a flange part with a flange with which the pressure cap is fastened to an end-face and annular sealing surface of a housing by being screwed into place. The flange is elastically deformed by the being screwed into place. The sealing surface of the housing in the region of a base zone of the flange stands in contact on this with a second sealing surface. The two sealing surfaces lie on two at least approximately radially extending conical or annular surfaces prior to the being screwed up. These two areas enclose a small angle $\chi$ which opens outwardly with respect to a central axis. After the screwing into place of the flange, the two sealing surfaces are pressed onto one another due to its elastic deformations and the angle between the sealing surfaces is thus equal to zero.

The invention will be described in the following with reference to the drawings.

DESCRIPTION OF THE PREFERRED EMBODIMENTS

Figure 1:
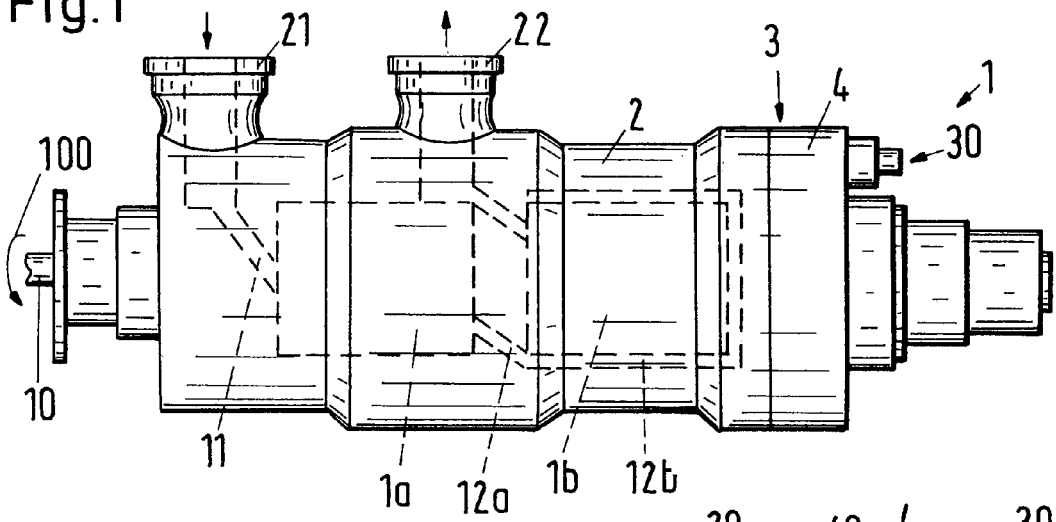
FIG. 1 is a side view of a pot housing pump.

A pot housing pump 1 such as is shown in FIG. 1 is a pump of the back-to-back type. It contains—in a housing 2—a first part pump 1*a* and a second part pump 1*b* which are set into motion in a clockwise or counterclockwise direction via a common shaft 10. The drive end is indicated by an arrow 100 which indicates the rotation. A liquid to be transported moves from a suction stub 21 at the drive end through passages 11 into the part pump 1*a* from which the liquid is transported via further passages 12*a*, 12*b* at a mean pressure $p_L$ (200 to 500 bar) to the end of the shaft remote from the drive, where it is redirected by a pressure cap 3 into the part pump 1*b*. After the transport through the second part pump 1*b*, the liquid is discharged from the pump 1 out of a centrally arranged pressure stub 22, with it having an end pressure which lies between approximately 400 and 1000 bar.

The following also applies to a pump of the in-line type which only includes a rotary pump and in which the pressure stub is arranged at the end, i.e. at the pressure cap. In this case, the pressure cap must provide a seal against a pressure $p_L$ of 1000 bar.

Figure 2:
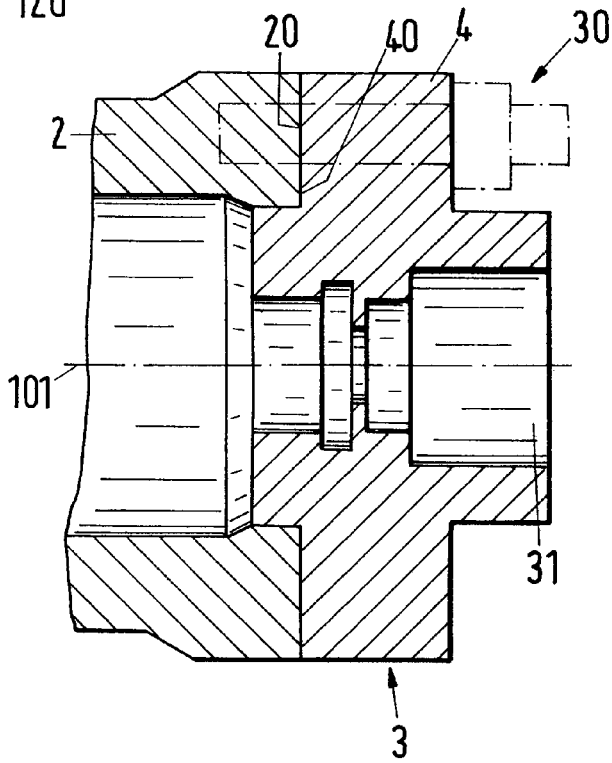
FIG. 2 is an elongate section through a pressure cap and a part of the housing of the pump shown in FIG. 1.
Figure 3:
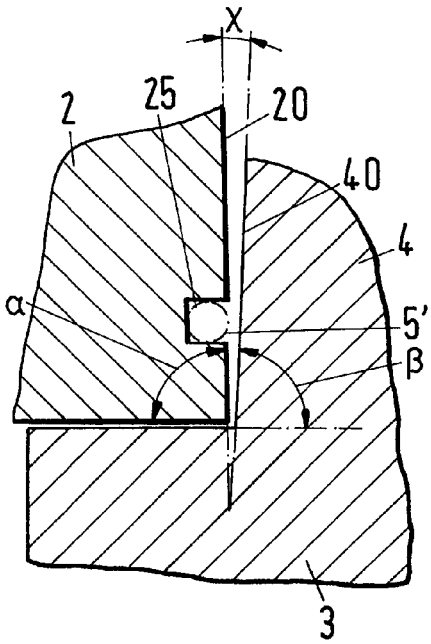
FIG. 3 shows details with respect to a pump in accordance with the invention in the region of the sealing surfaces between the pressure cap and the housing.

The pressure cap 3 of the pump 1 has—see also FIG. 2—a flange part with a flange 4 which has a sealing function. The pressure cap 3 supports a terminal shaft bearing in a profiled passage opening 31. An axial thrust relief device is installed in the pressure cap 3 as is a shaft seal with which a liquid discharge into the environment by a pressure reduction is minimized. The pressure cap 3 is screwed into place at an end-face and annular sealing surface 20 of the housing 2 by means of a plurality of expansion bolts 30 (only one drawn, chain-dotted line in FIG. 2) and the flange 4. The flange 4 is elastically deformed when being screwed into place such that the sealing surface 20 of the housing 2 in the region of a base zone of the flange 4 stands in contact on this with a second sealing surface 40. The two sealing surfaces 20, 40 lie on two at least approximately radially extending conical or annular surfaces prior to being screwed up, with these two surfaces enclosing, in accordance with the invention, a small angle $\chi$ which opens outwardly with respect to a central axis 101: see FIG. 3. A conical gap is thus located between the two sealing surfaces 20, 40. The angle $\chi$ of this conical gap amounts to a maximum of 1°. After the screwing into place of the flange 4 on the housing 2, the two sealing surfaces 20, 40 are pressed onto one another due to the elastic deformation of the flange 4: the conical gap is closed; the angle $\chi$ between the sealing surfaces 20, 40 is equal to zero in this condition.

The sealing surface 20 of the housing 2 encloses an angle $\alpha$ with the central axis 101 or with a straight line parallel to this. The second sealing surface 40 correspondingly encloses an angle $\beta$. The sum of the three angles $\alpha$, $\beta$, $\chi$ amounts to 180°. $\alpha$ is preferably a right angle. $\chi$ is equal to zero due to the deformation of the flange 4; thus, for $\alpha$=90°, $\beta$=90° also applies (=$\beta'$ in FIG. 4).

The sealing surface 20 of the housing 2 contains at least one annular groove 25, with a seal—in particular an O-ring—being placed into each annular groove 25. The sealing ring is indicated by a chain-dotted circle 5'. Due to the contact of the two sealing surfaces 20, 40, each annular groove 25 forms a largely closed chamber with the second sealing surface lying on.

Figure 4:
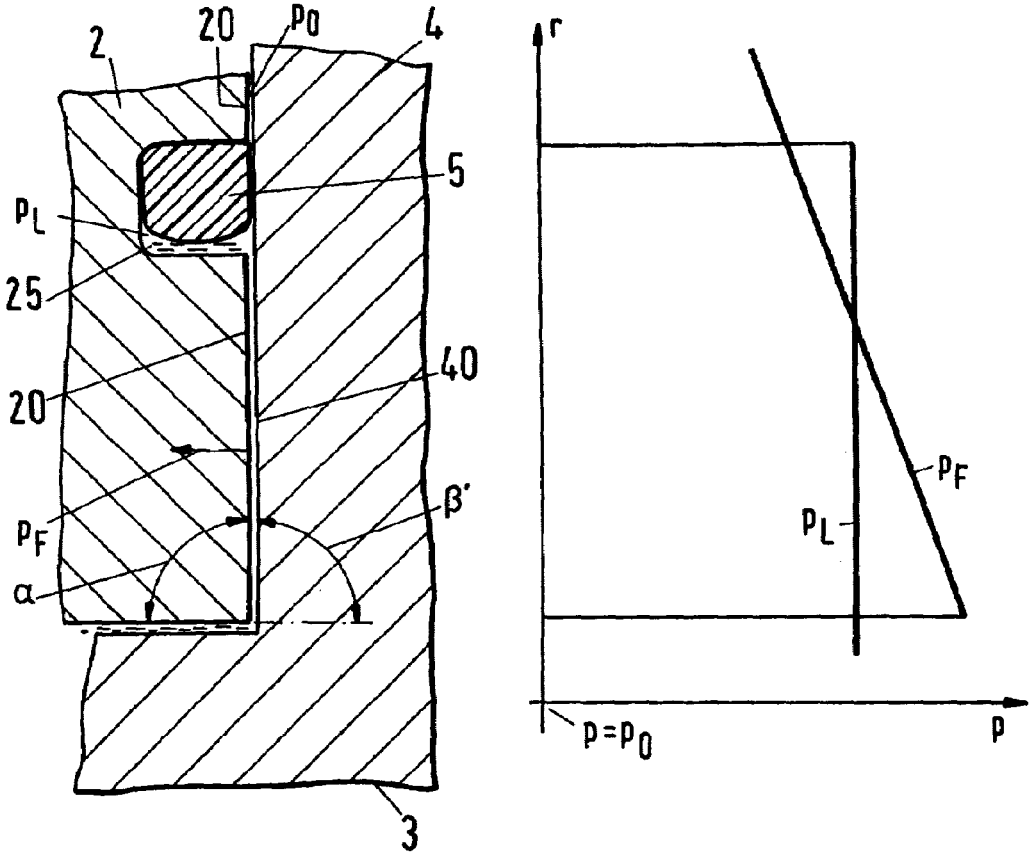
FIG. 4 shows details with respect to pressure forces which occur in the region of the seal shown in FIG. 3.

The condition with the flange 4 screwed into place is shown in FIG. 4. When being screwed into place, the second sealing surface 40 first contacts the sealing surface 20 of the housing 2 at the inner region. A contact pressure $p_F$ of the flange 4 is therefore the largest there and decreases as the radius r increases: see the diagram on the right-hand side of FIG. 4 in which the pressure curve within the contact region is shown, namely the base zone of the flange 4. The liquid with a pressure $p_L$ (cf. diagram on the right-hand side in FIG. 4) can penetrate between the sealing surfaces 20 and 40 up to and into the groove 25 such that the sealing ring 5 is pressed radially outwardly. The pressure is $p=p_0$ (for example ambient pressure) outside the seal. A gap between the sealing surfaces 20, 40 which is permeable to liquid is so narrow that the material of the sealing ring 5 cannot be extruded into these intermediate spaces. So that the flange 4 does not rise, the contact pressure $p_F$ must be sufficiently large with respect to the liquid pressure $p_L$. The larger the angle $\chi$ is selected, the larger $p_F$ is in the contact region. It is therefore possible to pre-set the contact pressure $p_F$ such that the flange 4 cannot rise. The pressure cap 3, or its flange 4, can be made such that with an internal pressure of up to 1000 bar—or even more—the two sealing surfaces 20, 40 remain in contact in the base zone of the flange 4.

Advantageously, two concentric annular grooves 25 with sealing rings 5 are provided (not shown). A sensor can be arranged between the two annular grooves 25 with which liquid can be registered which could flow through the seal lying further inward due to a leak.

The second sealing surface 40 does not necessarily have to lie on a conical surface; it can also be made slightly bulbous (convex).

The housing 2 and/or the pressure cap 3 is as a rule made of a metallic material, in particular of forged steel.

The pump in accordance with the invention can be used for the transport of water or of an aqueous solution—in particular seawater—at a pressure of at least 500 bar. The pressure can also amount up to 1000 bar or more.

The invention claimed is:

1. A high pressure rotary pump comprising a pot housing including a pressure cap which has a flange part with a flange with which the pressure cap is fastened to an end face and annular first sealing surface of the housing by being screwed into place so that the flange is elastically deformed, the flange defining a base zone and a second sealing surface, the first sealing surface including at least one annular groove and a seal placed into the at least one annular groove, the first sealing surface being in contact with the second sealing surface in the region of a base zone of the flange, the first and second sealing surfaces lying on two at least approximately radially extending conical or annular surfaces prior to being screwed up and enclosing a small angle $\chi$ which opens outwardly with respect to a central axis such that, after the screwing up of the flange, the first and second sealing surfaces are pressed onto one another due to its elastic deformations so that the angle between the sealing surfaces is equal to zero.

2. A pump in accordance with claim 1, wherein the first sealing surface encloses an angle $\alpha$ with the central axis and the second sealing surface encloses an angle $\beta$, wherein the sum of the angles $\alpha$, $\beta$ and $\chi$ amounts to 180° and wherein a is a right angle.

3. A pump in accordance with claim 1, wherein the at least one annular groove forms a largely closed chamber with the contacting second sealing surface such that an entry of liquid into this chamber is possible, but a discharge of the seal by extrusion is prevented.

4. A pump in accordance with claim 1, comprising first and second concentric annular grooves and seals disposed in the grooves, and a sensor arranged between the first and second annular grooves for the registration of a leak through the inwardly disposed seal.

5. A pump in accordance with claim 1, wherein the pressure cap is formed such that, with an internal pressure of up to at least 1000 bar, the first and second sealing surfaces remain in contact in the base zone of the flange.

6. A pump in accordance with claim 1, wherein the second sealing surface is slightly convex.

7. A pump in accordance with claim 1, wherein the housing and/or the pressure cap are produced from metallic material.

8. A pump according to claim 7 wherein the metallic material is forged steel.

9. Use of a pump in accordance with claim 1 for the transport of water or of an aqueous solution at a pressure of at least 500 bar.

10. Use of a pump according to claim 9 wherein the aqueous solution comprises seawater.

11. A pump according to claim 1 wherein the seal comprises an O-ring.

12. A high pressure rotary pump comprising a pot housing that includes an open end defining an annular, first sealing surface, a pressure cap covering the open end of the pot housing and including a flange which defines a second sealing surface for placement against the first sealing surface, the first and second sealing surfaces diverging in a radially outward direction relative to each other by a given angle, a fastener engaging the pot housing and the flange and elastically deforming the flange to force the first and second sealing surfaces into mutual engagement so that the given angle becomes zero to establish a seal between the first and second sealing surfaces, and including a seal placed between the sealing surfaces.

13. A high pressure rotary pump comprising a pot housing including a pressure cap which has a flange part with a flange with which the pressure cap is fastened to an end face and annular first sealing surface of the housing by being screwed into place so that the flange is elastically deformed, the flange defining a base zone and a second sealing surface which is slightly convex, the first sealing surface being in contact with the second sealing surface in the region of a base zone of the flange, the first and second sealing surfaces lying on two at least approximately radially extending conical or annular surfaces prior to being screwed up and enclosing a small angle $\chi$ which opens outwardly with respect to a central axis such that, after the screwing up of the flange, the first and second sealing surfaces are pressed onto one another due to its elastic deformations so that the angle between the sealing surfaces is equal to zero.

14. A pump in accordance with claim 13, wherein the sealing surface of the housing contains at least one annular groove and including a seal placed into the at least one annular groove.

15. A high pressure rotary pump according to claim 13 including a seal placed between the sealing surfaces.

16. A high pressure rotary pump according to claim 15 wherein the seal is an annular seal, and including an annular groove defined in at least one of the sealing surfaces in which the annular seal is disposed.

* * * * *